United States Patent [19]

Dana

[11] Patent Number: 4,647,734

[45] Date of Patent: Mar. 3, 1987

[54] BINARY SWITCH LOCK

[75] Inventor: Merrill A. Dana, W. Millbury, Mass.

[73] Assignee: Hudson Lock, Inc., Hudson, Mass.

[21] Appl. No.: 735,634

[22] Filed: May 20, 1985

[51] Int. Cl.[4] ..... H01H 27/08

[52] U.S. Cl. ..... 200/43.06; 200/43.08

[58] Field of Search ..... 200/43.08, 43.06, 6 BB, 200/61.61, 61.64, 155 A, 155 R, 67 DA; 206/328

[56] References Cited

U.S. PATENT DOCUMENTS

| | | | |
|---|---|---|---|
| 4,051,349 | 9/1977 | Englund | 200/43.06 |
| 4,091,244 | 5/1978 | Chu et al. | 200/6 BB |
| 4,231,901 | 11/1980 | Berbeco | 206/328 |
| 4,241,829 | 12/1980 | Hardy | 206/328 |
| 4,400,597 | 8/1983 | Bruder et al. | 200/6 BB |

FOREIGN PATENT DOCUMENTS

| | | | |
|---|---|---|---|
| 1298935 | 6/1962 | Italy | 200/43.06 |

*Primary Examiner*—Stephen Marcus
*Assistant Examiner*—Linda J. Sholl
*Attorney, Agent, or Firm*—John E. Toupal; Harold G. Jarcho

[57] ABSTRACT

A key controlled switching apparatus including a body for mounting in an enclosure, the body comprising a front body portion defining a front cylindrical shell and a rear housing secured thereto. A cylindrical locking plug defines a front keyway and is mounted for rotation between locked and open positions within the shell and a plurality of locking tumblers are retained by the plug and extend into the front keyway. Aligned with the locking plug and rotatable therewith is a switching plug extending into the rear housing and defining a rear keyway axially aligned with the front keyway. A plurality of stationary electrical contacts are retained by the rear housing and a plurality of movable electrical contacts are retained by the rear housing and each movable contact is engageable with a different one of the stationary electrical contacts. Extending into the switching plug are a plurality of actuators, each movable into an active position that moves a different one of the movable contacts into engagement with one of the stationary contacts. A key is insertable into the front and rear keyways and includes a front portion bitted to engage and produce movement of the tumblers and a rear portion having bitted portions shaped and arranged to engage and move predetermined ones of the actuators into their active positions. The switching plug accurately aligns the rear key portion and the actuators and guides movement thereof into their active positions.

21 Claims, 7 Drawing Figures

BINARY SWITCH LOCK

BACKGROUND OF THE INVENTION

This invention relates generally to a key activated switch and, more particularly, to a key activated switch providing binary coded switching outputs for use with microprocessor-based equipment.

Key controlled switches have been proposed for providing access to microprocessor-based equipment. The functions of such switches are to prevent use of equipment by unauthorized personnel and to identify authorized users thereof. Typically key operated switches include a bank of micro-switches integrally mounted with a conventional cylinder lock. A front portion of a proper key enters and is bitted to operate the cylinder lock while an extended rear key portion is bitted to selectively engage and activate predetermined switches in the bank thereby providing a binary output. Examples of key controlled switches are disclosed in U.S. Pat. Nos. 4,198,552; 4,104,490; 3,912,888; and 3,427,413. Problems associated with prior key controlled switches have included inadequate reliability of operation, excessive component cost and labor intensive assembly requirements. These problems stem primarily from the tight tolerances required to reliably activate micro-switches with conventionally bitted keys.

The object of this invention, therefore, is to provide an improved and relatively inexpensive key controlled switch that can be reliably operated to provide a predetermined binary output.

SUMMARY OF THE INVENTION

The invention is a key controlled switching apparatus including a body for mounting in an enclosure, the body comprising a front body portion defining a front cylindrical shell and a rear housing secured thereto. A cylindrical locking plug defines a front keyway and is mounted for rotation between locked and open positions within the shell and a plurality of locking tumblers are retained by the plug and extend into the front keyway. Aligned with the locking plug and rotatable therewith is a switching plug extending into the rear housing and defining a rear keyway axially aligned with the front keyway. A plurality of stationary electrical contacts are retained by the rear housing and a plurality of movable electrical contacts are retained by the rear housing and each movable contact is engageable with a different one of the stationary electrical contacts. Extending into the switching plug are a plurality of actuators, each movable into an active position that moves a different one of the movable contacts into engagement with one of the stationary contacts. A key is insertable into the front and rear keyways and includes a front portion bitted to engage and produce movement of the tumblers and a rear portion having bitted portions shaped and arranged to engage and move predetermined ones of the actuators into their active positions. The switching plug accurately aligns the rear key portion and the actuators and guides movement thereof into their active positions.

According to one feature of the invention, the locking and switching plugs are discrete components demountably engaged for common rotation, and the rear housing defines a rear shell portion retaining the switching plug. The rear shell portion accurately positions and guides rotational movement of the switching plug.

According to another feature of the invention, the switching plug defines a plurality of axially spaced apart, radial slots intersecting the rear keyway and each retaining one of the actuators. The slots are shaped and arranged to accommodate the actuators during rotational movement of the switching plug.

According to yet other features of the invention, each of the actuators comprises an elongated flexible arm portion having one end supported by the rear housing and an operating portion extending from an opposite end of the arm portion into one of the radial slots; each of the operating portions comprises an inner end shaped and arranged to be engaged and moved into its active position by a bitted portion of the rear key portion in response to rotation thereof and an outer end shaped and arranged to respond to the movement of the inner end by engaging and moving one of the movable contacts into engagement with one of the stationary contacts; and the movable contacts comprise elongated flexible contacts extending transversely to the switching plug; each of the flexible contacts having one end supported by the rear housing, an opposite end engageable with a different one of the stationary contacts, and an intermediate portion engaged by a different one of the outer ends in response to movement of the operating portion. This compact, efficient arrangement produces the desired switching in response to key movement.

According to a further feature of the invention, the front body portion comprises a mounting portion adapted to be secured to and engaged by the enclosure and formed from a material comprising a substantial amount of carbon so as to function as an electrical resistance. The resistance mounting portion protects sensitive equipment from electrostatic discharge damage.

According to still another feature of the invention, the switching plug, the actuators; movable contacts and the stationary contacts are shaped and arranged such that engagement between an input set of the movable and stationary contacts occurs only after engagement between any other set thereof. This features insures that all output switches are closed before a voltage is applied to the input switch.

According to yet other features of the invention, the rear shell portion defines an inwardly projecting, longitudinally disposed and tapered rib that engages an outer edge of the key with the locking plug in its open position, and the rear plug and actuators are shaped and arranged such that with the locking plug in its open position the actuators engage the key and exert thereon a force tending to rotate the locking plug in a sense required for movement thereof between its locked and open positions. These features securely retain the locking plug in its open position and thereby enhance the integrity of the switching outputs. In addition the longitudinally disposed rib compensates for a slightly tapered rear shell surface produced during molding operations and thereby improves the fit provided between the rear shell and the switching plug.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
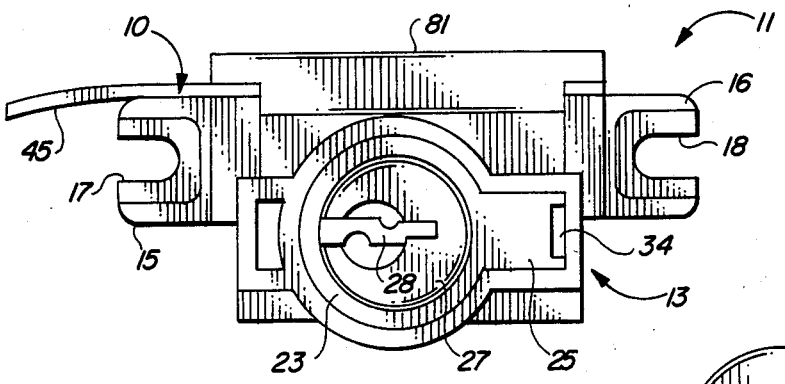
FIG. 1 is a schematic front view of a switching apparatus according to the invention.
Figure 2:
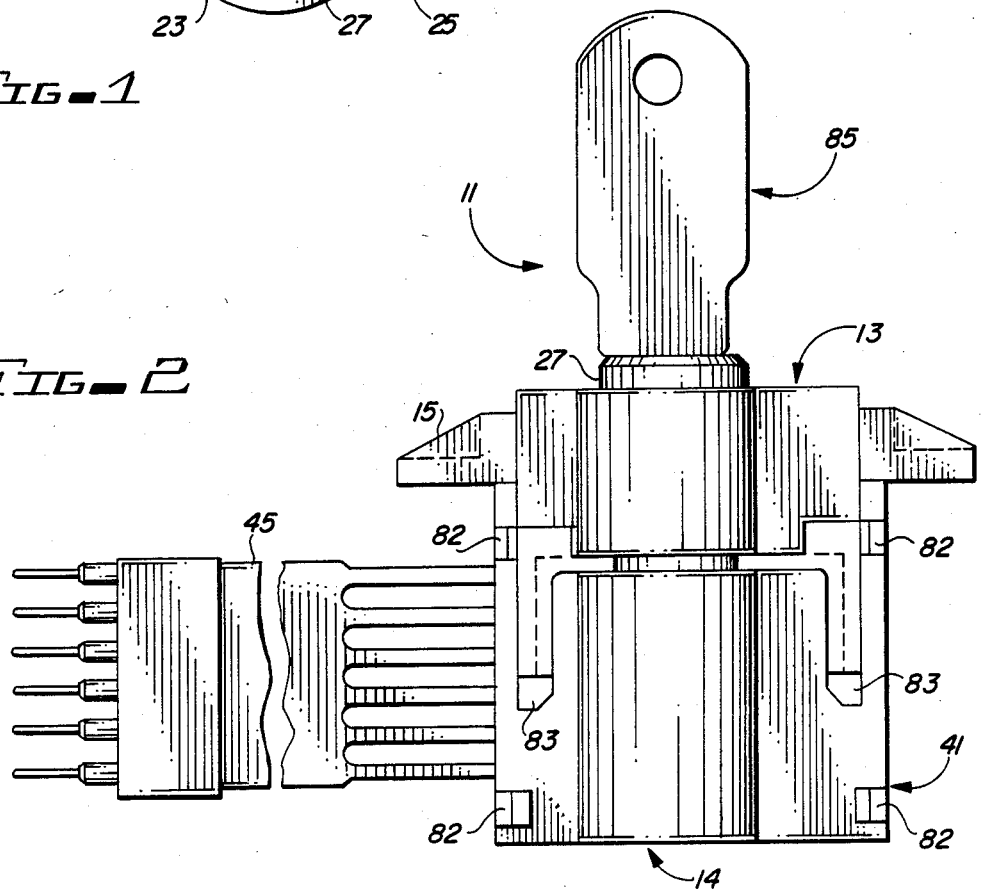
FIG. 2 is a schematic bottom view of the apparatus shown in FIG. 1.
Figure 3:
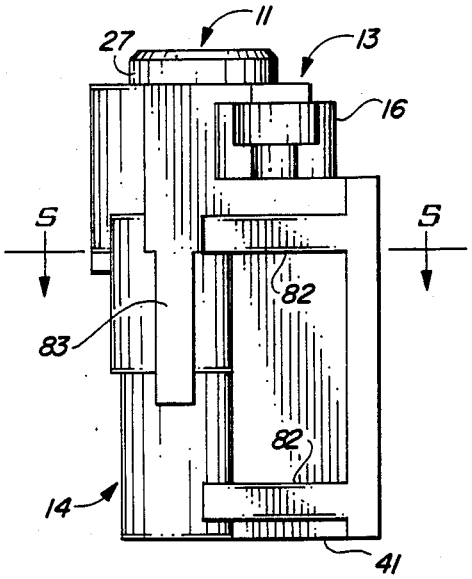
FIG. 3 is a schematic right side view of the apparatus shown in FIGS. 1 and 2.
Figure 4:
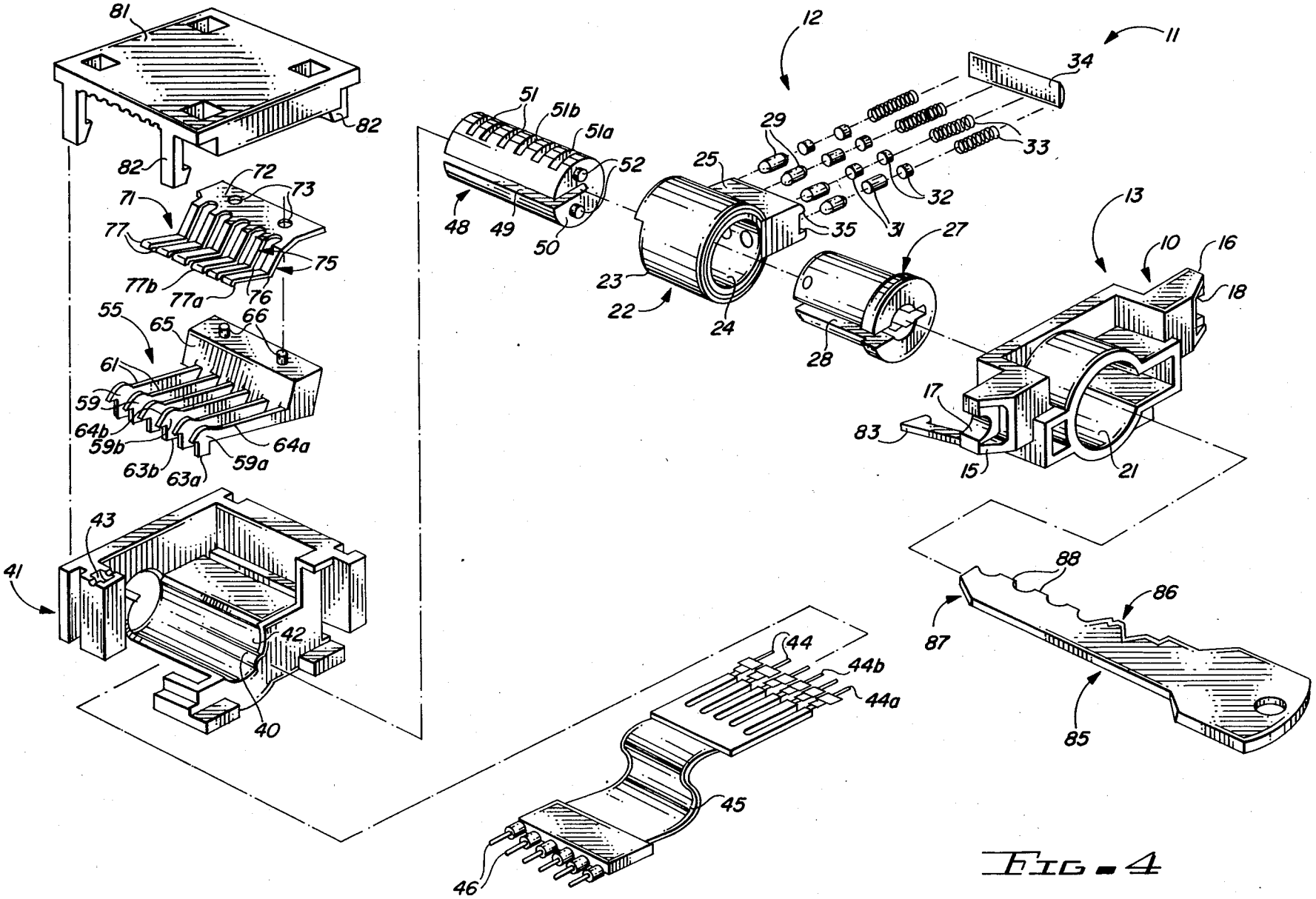
FIG. 4 is an exploded perspective view of the apparatus shown in FIGS. 1–3.

Referring now to FIGS. 1–4 there is shown a key controlled switching device 11 according to the invention. Included in the device 11 is a body 12 comprising a front body portion 13 and a rear housing portion 14. The front body portion 13 is adapted for mounting in an opening of an enclosure (not shown). Extending diametrically from the front body portion 13 are tabs 15, 16, each having slots 17, 18 for accommodating a mounting screw (not shown). The body portion 13 defines a cavity 21 that receives a front shell 22. Formed by the front shell 22 is a portion 23 that defines a cylindrical cavity 24 and a casing portion extending laterally thereform. A cylindrical locking plug 27 is rotatably mounted within the cylindrical cavity 24 and defines a front keyway 28. Retained in a conventional manner by the casing 25 are a plurality of locking tumbler pins 29 that project into the front keyway 28. Operatively associated with the locking pins 29 are master pins 31, top pins 32 and springs 33, all retained in the casing 25 by a slide member 34. Opposite edges of the slide member 34 engage slots 35 in the casing 25.

The rear housing portion 14 includes a main housing 41 that defines a rear shell portion 42. An inwardly tapered, longitudinal rib 40 extends between front and rear ends of the rear shell portion 42. Formed in one edge of the main housing 41 are a plurality of grooves 43, each of which accommodates a stationary electrical contact 44 of a flat ribbon cable connector assembly 45. Contacts 46 at the opposite end of the cable assembly 45 are adapted for connection to electrical equipment (not shown) to be controlled. Retained in the rear shell portion 42 is a cylindrical switching plug 48 that defines a rear keyway 49. Also defined by the switching plug 48 are a plurality of axially spaced apart, radial slots 51, **51*a* and 51*b* that intersect the rear keyway 49. Extending from a front face 50 of the switching plug 48 are a pair of pins 52 that are received by openings (not shown) in the rear surface of the locking plug 27 so as to produce axial alignment between the front keyway 28 and the rear keyway 49. In addition, the engagement between the pins 52 and the locking plug 27 insures common rotation thereof with the switching plug 48**.

Retained by the rear housing 14 is a molded actuator assembly 55 including a support block 56 disposed laterally adjacent to the switching plug 48 in the rear shell portion 42. A plurality of spaced apart, elongated activators 58 have inner ends fixed to the support block 56 and outer operating portions 59, **59*a* connected to the block 56 by flexible, intermediate arm portions 61. Each of the operating portions 59, 59*a*, 59*b* extends into a different one of the radial slots 51, 51*a*, 51*b* of the switching plug 48 and inner ends 63, 63*a*, 63*b* thereof project into the rear keyway 49. Outer ends 64, 64*a*, 64*b* of the operating portions extend out of the radial slots into the upper portion of the rear housing 14. Projecting upwardly from an upper surface 65 of the block 56 are a pair of cylindrical studs 66. Preferably, the actuator 55** is an integrally molded unit.

Also retained within the rear housing 14 is an electrical contact comb assembly 71. The comb assembly 71 includes a base portion 72 that is supported on the upper surface 65 of the block 56 and laterally retained thereon by apertures 73 that receive the studs 66. A plurality of elongated, flexible contacts 75 comprise flexible intermediate. portions 76. One end of each of the spaced apart, intermediate portions 76 is joined to the base portion 72 while opposite ends 77, **77*a*, 77*b* thereof are bent downwardly to form contact surfaces. Closing the rear housing 14 is a cover 81. A flexible, latching tab 82 extends downwardly from each corner of the cover 81 and engages the bottom surface of the rear housing 14. Similar latching tabs 83 project rearwardly from the mounting portion 10 and engage the main housing 41 to secure the rear housing 14 to the front body portion 13**.

OPERATION

In typical use, the switching device 11 is mounted within a fitted opening of an enclosure (not shown) such as a cash register, and is retained therein by mounting screws accommodated by the slots 17, 18 in the front body portion 13. The pin contacts 46 in the flat ribbon cable 45 are connected to mating terminals in a circuit board of a binary electrical control system (not shown). After installation of the device 11 the locking pins 29, master pins 31, top pins 32 and bias springs 33 function in a conventional manner to prevent rotation of the locking plug 27 in the absence of a proper key. However, upon entry of a key 85 (FIG. 4) into the front keyway 28 and the rear keyway 49, a properly bitted front key portion 86 will draw the locking pins 29 into shear positions permitting rotation of the locking plug 27 in a counterclockwise direction from the locked position shown in FIGS. 1, 2 and 4. Opening rotational movement of the locking plug 27 is accompanied by common rotational movement of the engaged switching plug 48 to an open position shown in FIG. 7. That rotation of the switching plug 48 within the rear shell portion 42 effects predetermined electrical switching within the rear housing 14 as described hereinafter.

Figure 6:
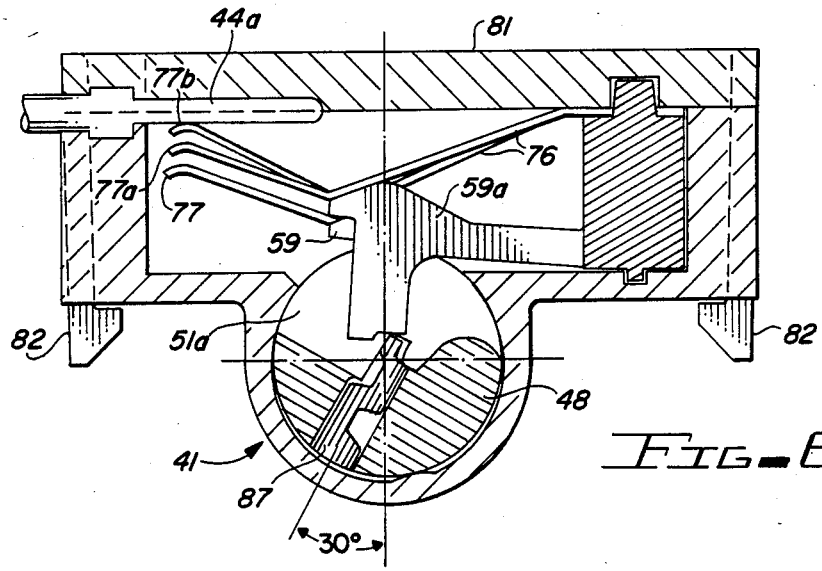
FIG. 6 is a schematic cross-sectional view similar to FIG. 5 but with the apparatus in a different operating position.
Figure 7:
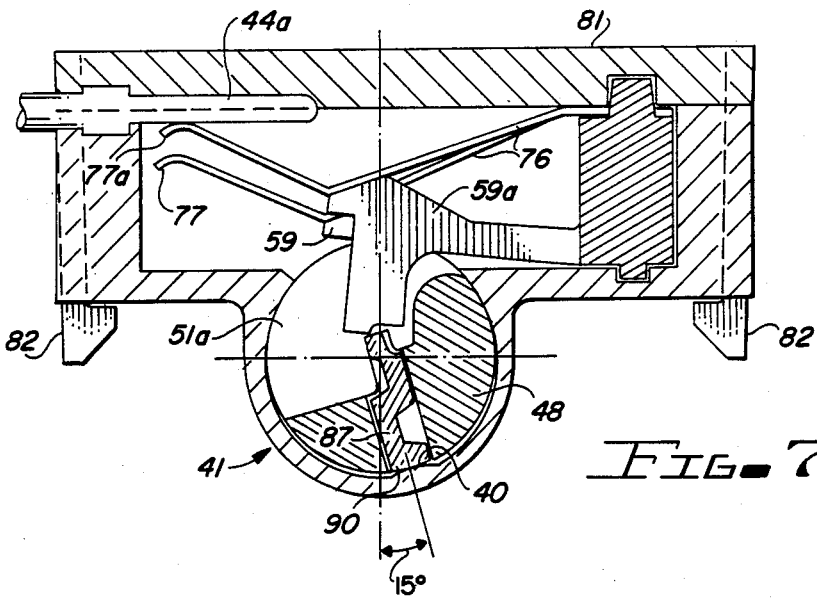
FIG. 7 is a schematic cross-sectional view similar to FIGS. 5 and 6 but with the apparatus in still another operating position.

A rear portion 87 of the key 85 is selectively bitted to possess elevations 88 that are aligned with predetermined ones of the radial slots 51 in the switching plug 48. During rotation of the switching plug 48 between its locked and open positions, the elevations 88 on the rear key portion 87 engage the inner ends 63 of aligned operating portions 59 moving them upwardly as shown in FIGS. 6 and 7. This movement of the operating portions 59 is permitted by the flexibility of the arm portions 61 that extend between the support block 56 and the operating portions 59. As the predetermined operating portions 59 that are aligned with the elevations 88 on the key 85 move into their active positions, their outer ends 64 drive the aligned flexible contacts 75 upwardly producing contact between their outer ends 77 and aligned ones of the stationary contacts 44 in the ribbon cable 45 as also shown in FIGS. 6 and 7. Thus, preselected ones of the stationary contacts 44 in the ribbon cable 45 become interconnected via the conductive paths provided by the activated movable contacts 75 and the support end 72 of the connector comb 71.

In the embodiment specifically illustrated, the only two elevations 88 on the rear key portion 87 are aligned with the radial slots 51*a*, 51*b* of the switching plug 48. Consequently, rotational movement of the switching plug 48 into its open position moves the operating portions 59*a*, 59*b* into active positions; and moves the contact ends 77*a*, 77*b* into engagement, respectively, with the stationary contact pins, 44*a* and 44*b* to produce an electrical connection therebetween via the intermediate contact portions 76 and the support end 72 of the contact comb 71. Conversely, all other stationary pin contacts 44 aligned with inactive operating portions 59 of the activators 58 remain disengaged from aligned electrical contacts 75 and thereby remain electrically isolated.

In a preferred embodiment, the electrical connections to the pins 46 in the ribbon cable 45 are such as to provide an a voltage input on the stationary contact 44*a* while the remaining stationary contacts 44 provide binary outputs. It will be apparent in that case, that each of a number of keys 85 with uniquely bitted rear key portions 87 will activate a unique combination of the operating portions 59. Thus, each such key will produce engagement between a unique combination of the movable contacts 75 and the stationary contacts 44 to provide a unique binary output on the output pins 46.

Figure 5:
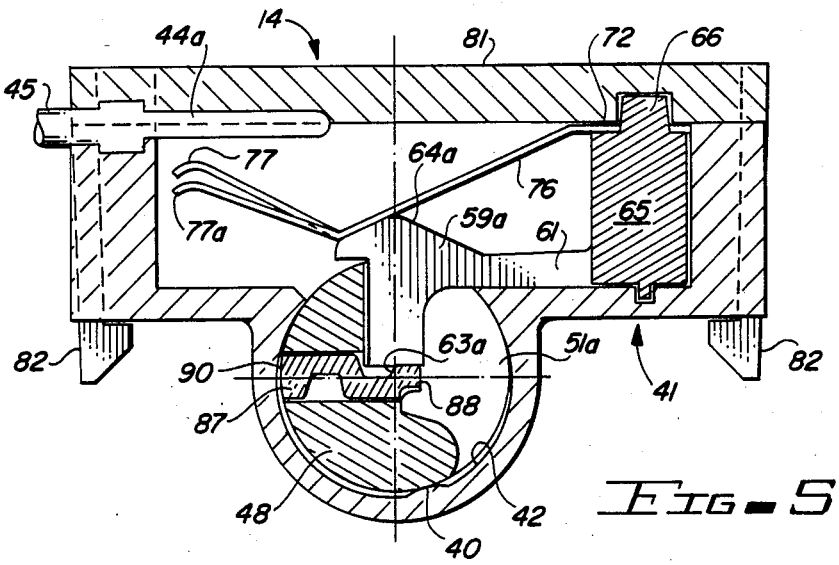
FIG. 5 is a schematic cross-sectional view taken along lines 5—5 in FIG. 3.

In the embodiment shown in FIG. 5, the first movable end contact 77*a* is in an inactive position, less elevated than the remaining end contacts 77, 77*b*. In addition, a voltage input is provided on the first stationary pin contact 44*a*. In that case, all control keys 85 would be provided with elevations 88 aligned with the first operating portion 59*a* so as to provide in all cases an input voltage to a predetermined combination of the output contacts 44, 44*b*. Furthermore, because of the less elevated first stationary contact 77*a*, contact will be established between each predetermined set of movable contacts 75 and stationary contacts 44, 44*b* before contact is created between the first movable contact 77*a* and the fixed input contact 44*a* in the cable 45. That operation is illustrated in FIGS. 5–7. In a position of the switching plug 48 (FIG. 6) between its open and locked positions, the more elevated movable contact 77*b* has moved into engagement with the stationary pin contact 44*b* while the less elevated, first movable contact 77*a* has not yet moved into contact with the stationary input contact 44*a*. Subsequent movement of the switching plug 48 into its fully open position (FIG. 7) provides further upward movement of the first movable contact 77*a* to produce engagement thereof with the stationary input contact 44*a* and thereby providing a voltage input to the switching comb assembly 71. In this preferred embodiment, the predetermined, key determined outputs of the switching assembly 71 are desirably established prior to the establishment of a voltage input on the first movable contact 77*a*.

The electrical switching characteristics of the device 11 are enhanced by the geometry of the flexible intermediate portions 76 of the movable contacts 75. As shown in FIGS. 5–7 the intermediate portions 76 are V-shaped and arranged such that engagement is produced between preselected movable contact ends 77*a*, 77*b* and stationary contacts 44*a*, 44*b* prior to movement of the switching plug 48 into a fully open position. After initial engagement on the contacts, the additional movement of the switching plug 48 produces further upward movement of the intermediate portions 76 and resultant longitudinal expansion of the V-shaped flexible contacts 75. That action results in a sliding movement of the movable contacts 77*a*, 77*b* along the engaged stationary contacts 44*a*, 44*b* resulting in a beneficial electrical wiping action.

In the illustrated and preferred embodiment of the device 11, movement of the switching plug 48 between its locked and open positions entails counterclockwise rotation of the key 85 between an initial horizontal or three o'clock position (FIG. 5) to an open position 15° past the vertical or twelve o'clock position (FIG. 7). In that fully open position, the engaged flexible, intermediate portions 76 of the contact assembly 71 exert via the operating portions 59*a*, 59*b* forces tending to produce additional counterclockwise rotation of the key 85. These applied forces provide the desirable function of biasing the switching plug 48 in its open position and thereby resisting inadvertent clockwise movement thereof that could degrade the electrical contact between engaged movable contacts 77*a*, 77*b* and stationary contacts 44*a*, 44*b*.

Active position stability of the device 11 is further enhanced by the longitudinal, tapered rib 40 in the rear shell portion 42. As the switching plug 48 rotates into its active position, an outer edge 90 of the key 85 is forced to ride onto the rib 40 into a final active position aligned therewith as shown in FIG. 7. Accordingly, the tapered, longitudinal ridge 40 functions as a detent that retains the switching plug 48 in its active position requiring the application of sufficient clockwise torque to move the outer edge 90 of the rear key portion 87 off of rib 40. In addition, the rib 40 compensates for a natural taper in the rear shell portion 42 that is produced during a typical production molding operation. Because of that compensation, there is established between the switching plug 48 and the rear shell portion 42 a more uniform longitudinal fit that increases the functional reliability of the operative elevations 88 on the rear key portion 87.

Obviously, many modifications and variations of the present invention are possible in light of the above teachings. It is to be understood, therefore, that the invention can be practiced otherwise than as specifically described.

What is claimed is:

1. A key controlled switching apparatus comprising:

a body means for mounting in an enclosure, said body means comprising a front body portion means and a rear housing means secured thereto, and said front body portion means defining a front cylindrical shell;

a cylindrical locking plug mounted for rotation between locked and open positions within said shell and defining a front keyway;

a plurality of locking tumblers retained by said plug and extending into said front keyway;

a switching plug axially aligned with said locking plug and rotatable therewith, said switching plug extending into said rear housing means, and defining a rear keyway axially aligned with said front keyway;

a plurality of stationary electrical contacts retained by said rear housing means;

a plurality of movable electrical contacts retained by said rear housing means and each engageable with a different one of said stationary electrical contacts;

a plurality of actuators retained by said rear housing means and extending into said switching plug and each movable into an active position that moves a different one of said movable contacts into engagement with one of said stationary contacts, said switching plug being rotatable with respect to said actuators; and a key insertable into said front and rear keyways, said key comprising a front portion bitted to engage and produce movement of said tumblers, and a rear portion having bitted portions shaped and arranged to engage and move predetermined ones of said actuators into said active positions.

2. An apparatus according to claim 1 wherein said locking and switching plugs are discrete components demountably engaged for common rotation.

3. An apparatus according to claim 1 wherein said rear housing means defines a rear shell portion retaining said switching plug.

4. An apparatus according to claim 3 wherein said switching plug defines a plurality of axially spaced apart, radial slots intersecting said rear keyway and each retaining one of said actuators; said slots shaped and arranged to accommodate said actuators during rotational movement of said switching plug.

5. An apparatus according to claim 4 wherein each of said actuators comprises an elongated flexible arm portion having one end supported by said rear housing means and an operating portion extending from an opposite end of said arm portion into one of said radial slots.

6. An apparatus according to claim 5 wherein each of said operating portions comprises an inner end shaped and arranged to be engaged by and moved into said active position by a said bitted portion of said rear key portion in response to rotation thereof, and an outer end shaped and arranged to respond to said movement of said inner end into said active position by engaging and moving one of said movable contacts into engagement with one of said stationary contacts.

7. An apparatus according to claim 6 wherein said movable contacts comprise elongated flexible contacts extending transversely to said switching plug; each of said flexible contacts having one end supported by said rear housing means, an opposite end engageable with a different one of said stationary contacts, and an intermediate portion engaged by a different one of said outer ends in response to said movement of said operating portion.

8. An apparatus according to claim 7 wherein said flexible contacts extend substantially tangential to said switching plug.

9. An apparatus according to claim 8 wherein said actuators and said switching plug are shaped and arranged such that, with said locking plug in said open position, said actuators engage said rear portion of said key and exert thereon a force tending to rotate said locking plug in a sense required for movement thereof between said locked and said open positions.

10. An apparatus according to claim 9 wherein said switching plug, said actuators, said movable contacts and said stationary contacts are shaped and arranged such that engagement between one set of said movable and stationary contacts occurs only in response to a greater degree of rotational movement by said switching plug than that required to produce engagement between any other set thereof such that said other sets of contacts always engage before said one set.

11. An apparatus according to claim 9 wherein said front body portion means comprises a mounting portion adapted to be secured to and engaged by the enclosure, said mounting portion being formed from a material comprising a substantial amount of carbon so as to function as an electrical resistance for dissipating static electricity through the enclosure so as to isolate therefrom said movable contacts.

12. An apparatus according to claim 1 wherein said rear housing means defines a rear shell portion retaining said switching plug, and said shell portion defines an inwardly projecting longitudinally disposed rib.

13. An apparatus according to claim 12 wherein said rear keyway extends radially in said switching plug and intersects an outer surface thereof, said rear keyway passing over said longitudinally disposed rib during movement of said locking plug between said locked and open positions, and said rear keyway lies directly adjacent and parallel to said rib with said locking plug in said open position.

14. An apparatus according to claim 13 wherein said switching plug defines a plurality of axially spaced apart, radial slots intersecting said rear keyway and each retaining one of said actuators; said slots shaped and arranged to accommodate said actuators during rotational movement of said switching plug.

15. An apparatus according to claim 14 wherein each of said actuators comprises an elongated flexible arm portion having one end supported by said rear housing means and an operating portion extending from an opposite end of said arm portion into one of said radial slots.

16. An apparatus according to claim 15 wherein each of said operating portions comprises an inner end shaped and arranged to be engaged by and moved into said active position by a said bitted portion of said rear key portion in response to rotation thereof, and an outer end shaped and arranged to respond to said movement of said inner end into said active position by engaging and moving one of said movable contacts into engagement with one of said stationary contacts.

17. An apparatus according to claim 16 wherein said movable contacts comprise elongated flexible contacts extending transversely to said switching plug; each of said flexible contacts having one end supported by said rear housing means, an opposite end engageable with a different one of said stationary contacts, and an intermediate portion engaged by a different one of said outer ends in response to said movement of said operating portion.

18. An apparatus according to claim 17 wherein said flexible contacts extend substantially tangential to said switching plug.

19. An apparatus according to claim 8 wherein said actuators and said rear plug are shaped and arranged such that, with said locking plug in said open position, said actuators engage said rear portion of said key and exert thereon a force tending to rotate said locking plug in a sense required for movement thereof between said locked and said open position.

20. A key controlled switching apparatus comprising:

a body means for mounting in an enclosure and comprising a front body portion means and a rear housing means secured thereto; said front body portion means defining a front cylindrical shell;

a cylindrical locking plug mounted for rotation between locked and open positions within said shell and defining a front keyway;

a plurality of locking tumblers retained by said plug and extending into said front keyway;

a plurality of stationary electrical contacts retained by said rear housing means;

a plurality of movable electrical contacts retained by said rear housing means and each engageable with a different one of said stationary electrical contacts;

a key insertable into said front and rear keyways, said key comprising a front portion bitted to engage and produce movement of said tumblers, and a rear portion having selectively bitted portions; and a plurality of actuators, some of which are movable by said selectively bitted portions into active positions that move different ones of said movable contacts into engagement with said stationary contacts; said actuators and said switching plug being shaped and arranged such that, with said locking plug in said open position, said actuators engage said rear portion of said key and exert thereon a force tending to rotate said locking plug in a sense required for movement thereof between said locked and said open positions.

21. A key controlled switching apparatus comprising:

a body means for mounting in an enclosure and comprising a front body portion means and a rear housing means secured thereto; said front body portion means defining a front cylindrical shell;

a cylindrical locking plug mounted for rotation between locked and open positions within said shell and defining a front keyway;

a plurality of locking tumblers retained by said plug and extending into said front keyway;

a plurality of stationary electrical contacts retained by said rear housing means;

a plurality of movable electrical contacts retained by said rear housing means and each engageable with a different one of said stationary electrical contacts;

a plurality of actuators each movable into an active position that moves a different one of said movable contacts into engagement with one of said stationary contacts; and a key insertable into said front and rear keyways, said key comprising a front portion bitted to engage and produce movement of said tumblers, and a rear portion having bitted portions shaped and arranged to engage and move predetermined ones of said actuators into said active positions in response to rotational movements of said key; and wherein said actuators, said movable contacts and said stationary contacts are shaped and arranged such that engagement between one set of said movable and stationary contacts occurs in response to a lessor degree of rotational movement by said key than that required to produce engagement between any other set thereof such that said other sets of contacts always engage before said one set.

* * * * *